US005413217A

United States Patent [19]

Sauer

[11] Patent Number: 5,413,217

[45] Date of Patent: May 9, 1995

[54] FLANGE SUPPORT AND DISPLAY PACKAGE FOR SURGICAL INSTRUMENTS

[75] Inventor: Erik Sauer, Mason, Ohio

[73] Assignee: Ethicon Endo-Surgery, Cincinnati, Ohio

[21] Appl. No.: 234,751

[22] Filed: Apr. 28, 1994

[51] Int. Cl.[6] ..... B65D 5/38; B65D 6/06

[52] U.S. Cl. ..... 206/363; 206/461

[58] Field of Search ..... 229/167, 195; 206/363, 206/370, 461, 464, 465, 469, 45.15, 44 R

[56] References Cited

U.S. PATENT DOCUMENTS

| | | | |
|---|---|---|---|
| 3,215,333 | 11/1965 | Stelzer | 206/469 X |
| 3,246,747 | 4/1966 | Blish | 206/469 X |
| 3,487,915 | 1/1970 | Scott | 206/461 X |
| 3,827,621 | 8/1974 | Bliss | 229/167 |
| 5,002,187 | 3/1991 | Rysner et al. | 206/461 |
| 5,285,901 | 2/1994 | Huang | 206/461 X |
| 5,322,161 | 6/1994 | Shichman et al. | 206/363 X |
| 5,323,905 | 6/1994 | Gerondale et al. | 206/461 |

*Primary Examiner*—Jacob K. Ackun, Jr.
*Attorney, Agent, or Firm*—Paul A. Coletti

[57] ABSTRACT

There is contained a first package for holding the surgical instruments. The package contains a blister, with a flange surrounding the blister cavity, and an adhesive sealed lid attached to the blister flange. There is also contained a second package which has a lower surface, a pair of side walls extending perpendicularly from the lower surface, a pair of back walls perpendicular to both the side walls and the lower surface, and four inner walls each of which is parallel to one of the side walls or the back walls. A top surface connects the inner walls to one of the side walls or the back wall. The inner walls abut one another to form a "well" through which the blister can be displayed. Finally, the flange of the first package fits between each of the inner walls and the lower surface of the second package. In this fashion, the blister is displayed through the well; the first package is secure within the inner walls and lower surface of the second package and material is minimized through use of less cardboard in making the well assembly.

3 Claims, 2 Drawing Sheets

FLANGE SUPPORT AND DISPLAY PACKAGE FOR SURGICAL INSTRUMENTS

BACKGROUND OF THE INVENTION

The present invention describes a flange support and display package for surgical instruments. Specifically, the invention describes a blister package which may be displayed through the opening of a second cardboard package, in order to simultaneously secure and display these surgical instruments.

It is desirable to use minimum amounts of material to protect and display surgical instruments in packages. This is true both for environmental and economical reasons. One way to minimize use of materials is to exclusively use cardboard boxes to contain the surgical instruments, without using the more traditional plastic blister packages. However, with such an arrangement the sterility of the package can be compromised. The alternative, if one uses both a traditional (parallelepiped) cardboard box in which a blister package is contained, is an overuse of the cardboard material. Moreover, the instrument is not easily displayed when placed in the blister package within the cardboard package. Thus, it would be desirable to have both an easy to display, secure, economical, and environmentally prudent display system for surgical instruments.

SUMMARY OF THE INVENTION

The present invention describes such a desirable system. There is contained a first package for holding surgical instruments. The package contains a blister with a flange surrounding the blister cavity, and an adhesive sealed lid attached to the blister and the flange. There is also contained a second package which has a lower surface, a pair of side walls extending perpendicularly from the lower surface, a pair of back walls perpendicular to both the side walls and the lower surface, and four inner walls each of which is parallel to one of the side walls or the back walls. A top surface connects the inner walls to one of the side walls or the back walls. The inner walls abut one another to form a "well" through which the blister can be displayed. Finally, the flange of the first package fits between each of the inner walls and the lower surface of the second package. In this fashion, the blister is displayed through the well; the first package is secure within the inner walls and lower surface of the second package; necessary material is minimized through use of less cardboard in making the well assembly (as compared to a more standard box-shaped container); and, both environmental and economic concerns are met. In this fashion, the presently described package represents a marked improvement over more traditional packages.

DETAILED DESCRIPTION OF THE DRAWINGS

Figure 1A:
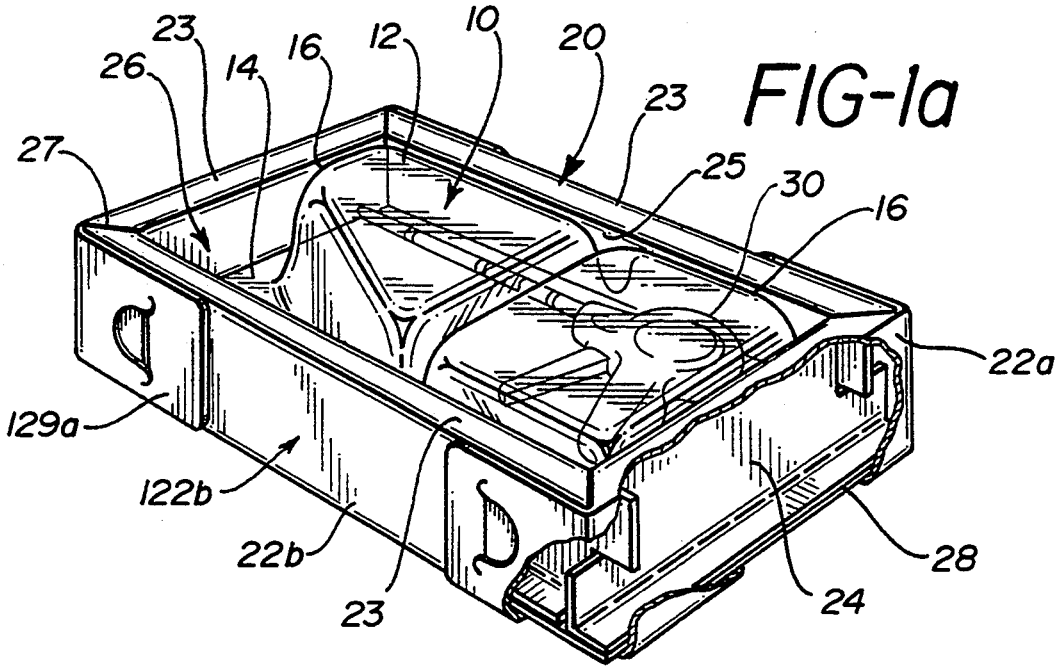
Figure 1B:
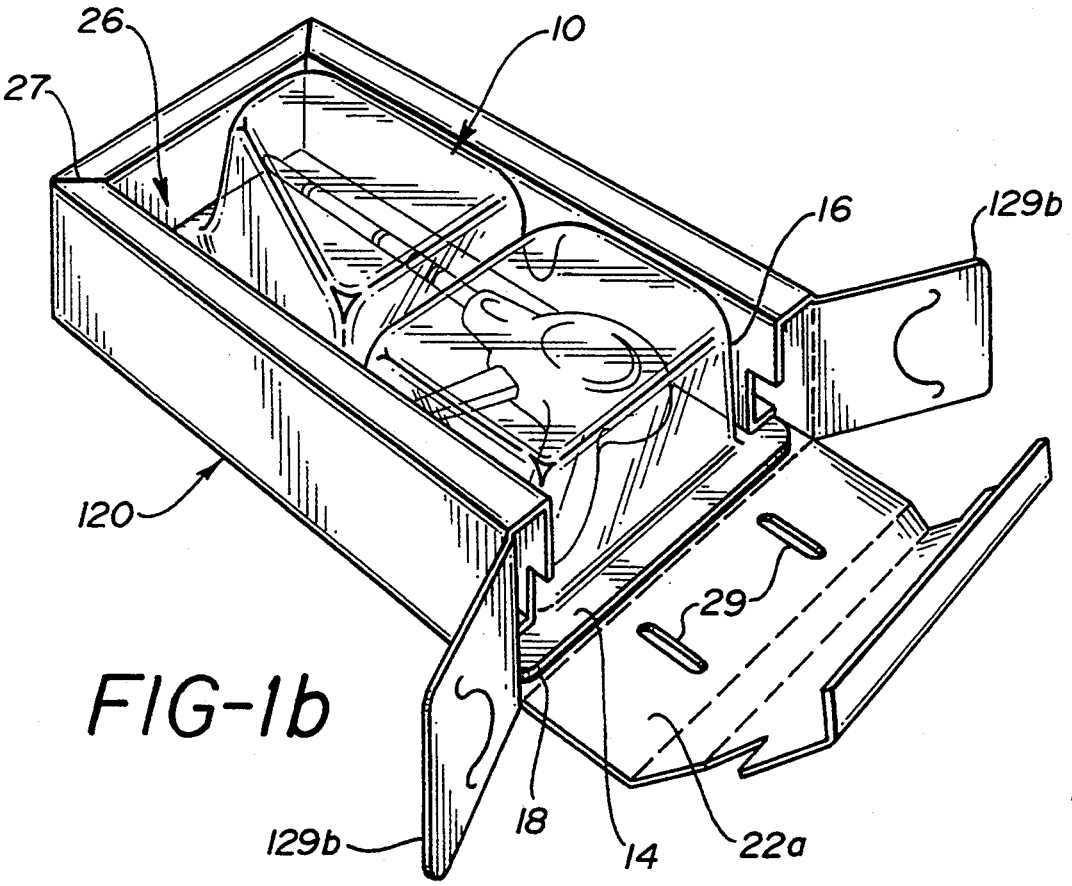
Figure 2:
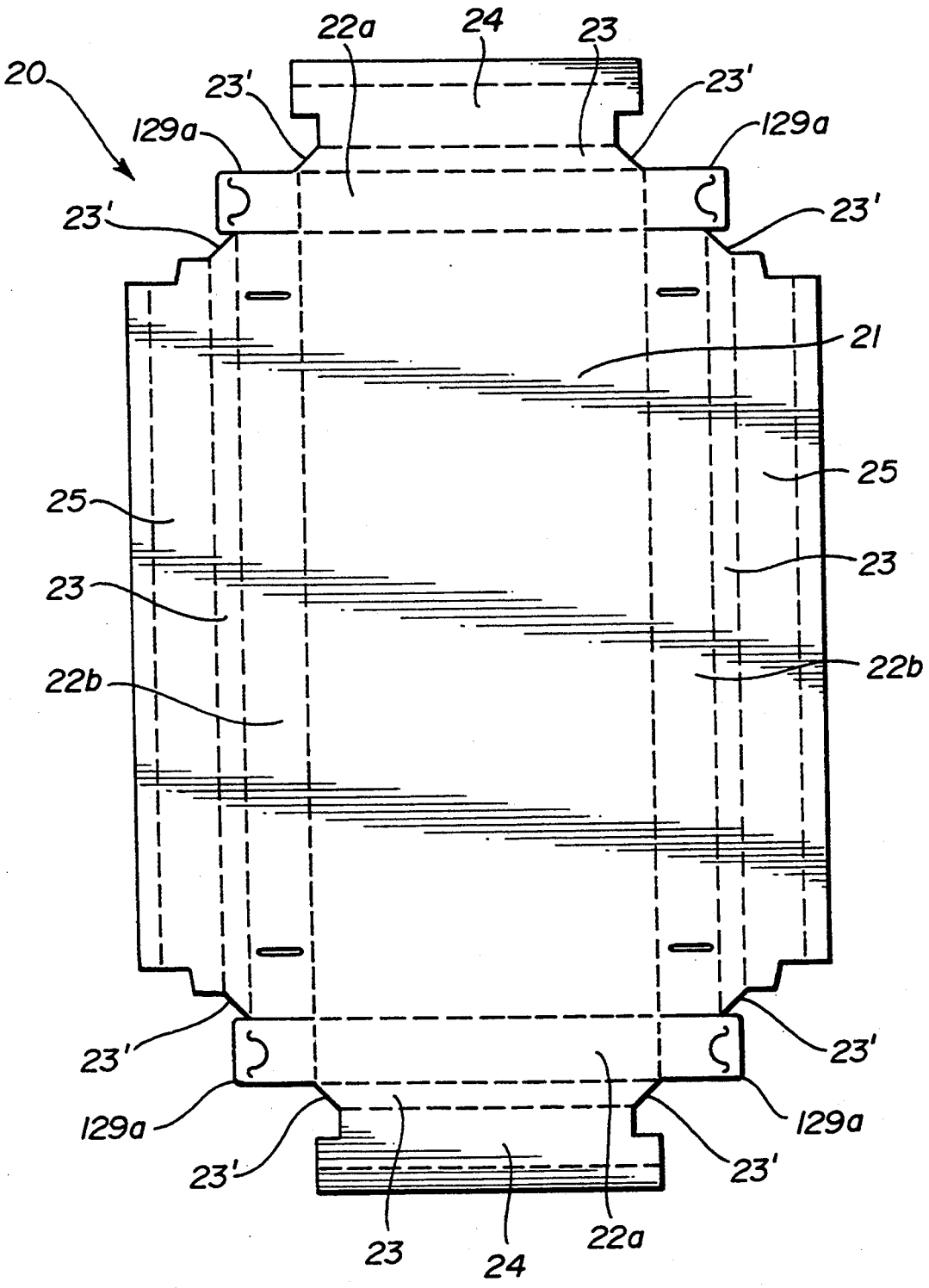

The invention described herein will be better understood in connection with the attached drawings wherein:

FIG. 1*a* describes a combination describing the present invention;

FIG. 1*b* describes an alternate embodiment of FIG. 1*a*, with a partial cross section describing the combination arrangement; and FIG. 2 describes an unfolded layout of the second package as depicted in FIG. 1*a*.

DETAILED DESCRIPTION OF THE INVENTION

As can be seen in FIGS. 1*a* and 2 there is described a combination of a first package 10 and a second package 20 through which a surgical instrument 30 can be stored and displayed. The first package 10 comprises a blister 12 normally formed from a plastic material, in which package 10 the surgical instrument 30 can be inserted. The blister 12 includes a flange 14 around all the four sides 16 of package 10, as can be better seen in FIG. 1*b*. This blister 12 is sealed adhesively by an adhesive lid 18 attached to both the blister flange 14, similarly seen in FIG. 1*b*.

It is this first package 10 which is inserted into the second package 20 which forms the combination uniquely described herein. The second package 20 can better be seen in both FIGS. 1*a* and 2. There is contained a lower surface 21 from which extend four walls 22*a*, 22*b*. The two back walls 22*a* are perpendicular to lower surface 21 and to the two side walls 22*b*. Each of these walls 22*a*, 22*b* are foldably attached to the lower surface 21. Each of the side and back walls 22*a*, 22*b* is further extended to be folded to a top surface 23. The top surface is parallel to the lower surface 21 and perpendicular to each of the back and side walls 22*a*, 22*b*. From each of the top surfaces 23 there is an inner wall 24, 25 which helps form the well 26 of the present device. The inner walls 24, 25 may be folded from the top surface 23 to become parallel to one another, and each of which will abut the surfaces of one another at seams 27. Thus, the four inner walls 24, 25 form a well 26 through which the blister 12 of the first package 10 may be displayed.

It will be noticed in FIG. 1*b* that each of the four inner walls 24, 25 does not extend for the entire length (or height) of the back walls 22*a* or side walls 22*b*. Thus, the gap 28 created between the inner walls 24, 25 and the lower surface 21 allows the flange 14 of the first package 10 to be secured between the inner walls 24, 25 and the lower surface 21. Thus, with one of the back walls 22*a* folded away from the lower surface 21, the flange 14 of the first package 10 may be slid under the three remaining inner walls 25, 24, and 25 between lower surface 21, so that the flange 14 is secured underneath the inner walls. Thereafter, the remaining back wall 22*a* and inner wall 24 are folded toward one another so that the well 26 is completed, and the first package 10 is securedly held within the second package 20. In this arrangement, the blister 12 is displayed in the well 26 so that the user can see the surgical instrument 30. Also, the first package 10 is securedly held by the second package 20 with an econominization of material, for environmental and economical purposes.

As can be better seen in FIG. 1*a*, the back and side walls 122*b* are secured to one another by folded flanges 129*a* which matedly secure one to the other as seen in FIG. 1*a* and in the foldout of FIG. 2. The 45° abutment surfaces 23' of the top surface 23 are also seen in FIG. 2 so that they matedly match one another, so that the unique arrangement is therein adequately described. Locking takes place along each of the back walls 122*b*. Alternatively, as can be seen in FIG. 1*b* locking may take place on either of the side walls 22*a* by having side locks 129*b* which mate with internal notches 29 contained in the side walls. Again, however, the arrangement of FIG. 1*a* is similar to that of FIG. 1*b* in that the flange 14 once again fits beneath the walls 24, 25 and above the lower surface 21 of the package 120.

It should also become apparent that other modifications may be possible with respect to the presently described package. It is intended that the scope of the invention described herein be determined from the attached claims and their equivalents.

I claim:

1. In combination:

a first package for holding surgical instruments, said package containing a blister having a cavity with a flange surrounding said cavity, and an adhesive sealed lid attached to said flange; and a second package containing a lower surface; a pair of side walls integrally joined to and extending perpendicularly from said lower surface; a pair of parallel back walls integrally joined to and extending perpendicularly from said lower surface, said back walls also being perpendicular to said side walls; four inner walls each of which is parallel to an associated one of said side walls and said back walls, and a top surface connecting each said inner wall to its associated one of said side walls and back walls;

each said inner wall abutting two other said inner walls to form a well through which said blister can be displayed; and wherein said flange fits between each of said inner walls and said lower surface.

2. The combination of claim 1 wherein at least one of said back walls is pivotable with respect to the top surface connecting it to its inner wall, such that said blister may be inserted into said well by sliding said first package along said lower surface with said flange between said inner walls and said lower surface.

3. The combination of claim 1 wherein at least one of said back walls is pivotable with respect to said bottom surface, such that said blister may be inserted into said well by sliding said first package along said lower surface with said flange between said inner walls and said lower surface.

* * * * *